United States Patent [19]

Mikulecky

[11] 4,101,996

[45] Jul. 25, 1978

[54] FOOT PROPELLED WATER VEHICLE

[76] Inventor: Larry Gene Mikulecky, 530 Shorepines Ave., Coos Bay, Oreg. 97420

[21] Appl. No.: 733,056

[22] Filed: Oct. 18, 1976

[51] Int. Cl.[2] ..... B63C 9/08

[52] U.S. Cl. ..... 9/1.3; 9/6 P; 9/348

[58] Field of Search ..... 114/68; 9/1.1, 1.3, 9/1.4, 1.5, 8 R, 11 R, 6 R, 6 P, 6 M, 301, 310 R, 310 D, 310 E, 311, 312, 329, 340, 347, 348, 349

[56] References Cited

U.S. PATENT DOCUMENTS

| | | | |
|---|---|---|---|
| 2,803,839 | 8/1957 | Mosley | 9/347 |
| 2,950,701 | 8/1960 | DeStefani | 9/6 |
| 3,102,280 | 9/1963 | Williams | 9/348 |
| 3,117,327 | 1/1964 | Mathew | 9/347 |
| 3,380,090 | 4/1968 | Kenmuir | 9/6 |
| 3,383,720 | 5/1968 | Greig | 9/6 |
| 3,813,717 | 6/1974 | Movsetis | 9/1.3 |

FOREIGN PATENT DOCUMENTS

| | | | |
|---|---|---|---|
| 1,192,277 | 5/1970 | United Kingdom | 9/349 |

*Primary Examiner*—Trygve M. Blix
*Assistant Examiner*—D. W. Keen
*Attorney, Agent, or Firm*—Kolisch, Hartwell, Dickinson & Stuart

[57] ABSTRACT

A foot propelled water vehicle includes a hard-shelled body having a generally annular periphery. The body has a seat cavity integrally formed with the body such that an individual may recline within the seat so that the individual's legs extend over a side. By kicking, the individual may propel the vehicle. The vehicle further includes a hollow interior for stowing equipment and a plurality of selectively openable and closeable hatches for permitting access into the interior.

3 Claims, 3 Drawing Figures

FOOT PROPELLED WATER VEHICLE

BACKGROUND AND SUMMARY OF THE INVENTION

The present invention relates to water vehicles, and more particularly to a novel, foot-propelled water vehicle of generally annular peripheral configuration having a seat for accommodating an individual. The individual's feet may depend from a vehicle side so that the vehicle may be propelled through the water by kicking action of the individual. Such a water vehicle finds particular utility in the use and enjoyment of water for recreational purposes such as river drifting, fishing, etc.

Water vehicles are, of course, well known for recreational use. Such water vehicles may take the form of inflatable rubber devices upon which an individual or individuals may sit or lie and propel the vehicle by kicking. Typical examples of such craft are the well known inflatable air mattress and innertubes. Such craft provide enjoyment and ready mobility on water but suffer from several drawbacks. For instance, both air mattresses and innertubes result in an individual user getting a substantial portion of the individual's body wet. If an individual sits within an innertube, the backside becomes at least partially submerged in water. Likewise, the so-called inflatable air mattress presents no barrier to an individual becoming wet.

Other types of water craft have been developed which are directed to providing mobility and safety. A typical example is illustrated in U.S. Pat. No. 2,894,270 wherein there is disclosed a so-called water saddle including an inflatable outer member having an internal cavity with two openings so that the legs of an occupant can pass therethrough. However, with the legs of an occupant so inserted into the water, the openings still permit water to pass between the outer edges of the openings and the individual's legs such that water could at least partially fill the seat cavity. This vehicle is also contemplated as being constructed of inflatable material and thus subject to puncture or other damage if the vehicle is used in areas having submerged branches or rock outcroppings. Such areas may be located in those water bodies especially attractive for fishing.

Another example of a watercraft is described in U.S. Pat. No. 2,803,839 wherein is disclosed a buoyant chair including a buoyant tube in generally rectangular configuration to which is secured a flexible main body portion which serves as a seat. The main body portion is secured to the inflatable ring by means of a peripheral tube arrangement. While the vehicle so described provides a small watercraft by which an individual may propel forwardly by kicking action, the vehicle is constructed such that water may contact the individual's backside because of space between the outer inflatable member and the flexible seat.

The present invention is directed to overcoming the aforementioned problems, as well as others, exemplary of the prior art. Accordingly, the present invention is directed to providing a relatively small, hard-shelled water vehicle within which an individual may sit or partially recline such that the individual's legs extend over a vehicle front side so that kicking action of the feet propel the vehicle. Further, the present invention provides a water vehicle in which a contoured seat is integrally formed therewith for permitting the major portion of a seated individual's weight to be situated somewhat over the central portion of the vehicle to thereby promote stability.

Another object of the present invention is to provide a hard-shelled water vehicle in which the seat of the vehicle is provided with inclined front and rear portions arranged to accommodate the majority of an individual's body out of the water. Thus, only an individual's feet and a small portion of the lower leg will become wet.

Still another object of the present invention is to provide a hard-shelled water vehicle which may be constructed as a single unit having a hollow interior so that equipment and gear may be stored therewithin. Further to this end, the hard-shelled construction of the water vehicle permits the location of a plurality of water tight hatches which provide access into the vehicle's interior.

Still another object of the present invention is to provide a hard-shelled water vehicle which has a generally annular configuration, somewhat similar to an innertube so that an individual may enjoy much the same mobility and pleasure of operating an innertube without having the individual's backside and upper legs become wet.

A further object of the present invention is to provide a hard-shelled water vehicle which permits attachment thereto of devices for holding fishing poles or other equipment.

Yet another object of the present invention is to provide a hard-shelled water vehicle having an interior which may be filled with flotation material to enhance buoyancy.

These and other objects and advantages will become apparent as further consideration is given to the following detailed description and the accompanying drawing.

BRIEF DESCRIPTION OF THE DRAWINGS

Novel features of the self-propelled water vehicle in accordance with the present invention will be more readily understood from a consideration of the following description taken together with the accompanying drawings, in which a preferred embodiment is illustrated with the various parts thereof identified by suitable reference characters in each of the views, in which.

DETAILED DESCRIPTION OF THE INVENTION

Figure 1:
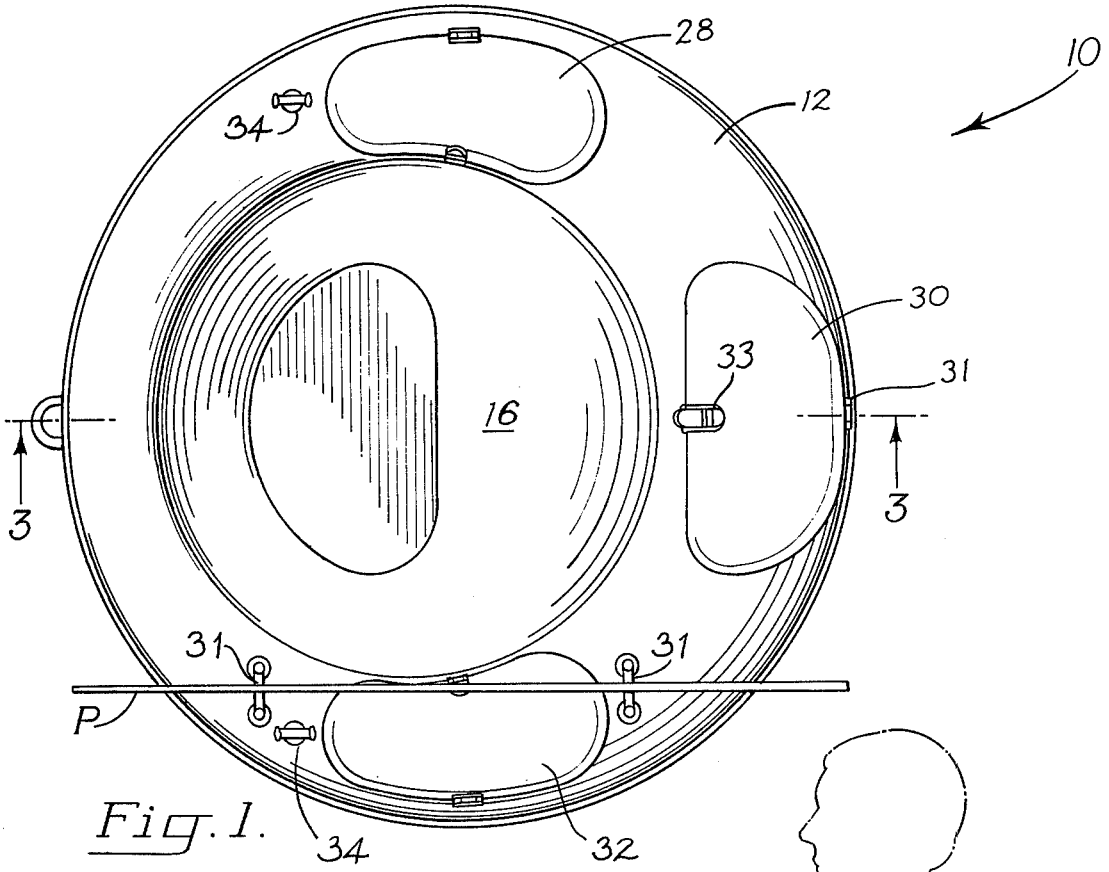
FIG. 1 is a top plan view of a self-propelled water vehicle of the present invention.
Figure 2:
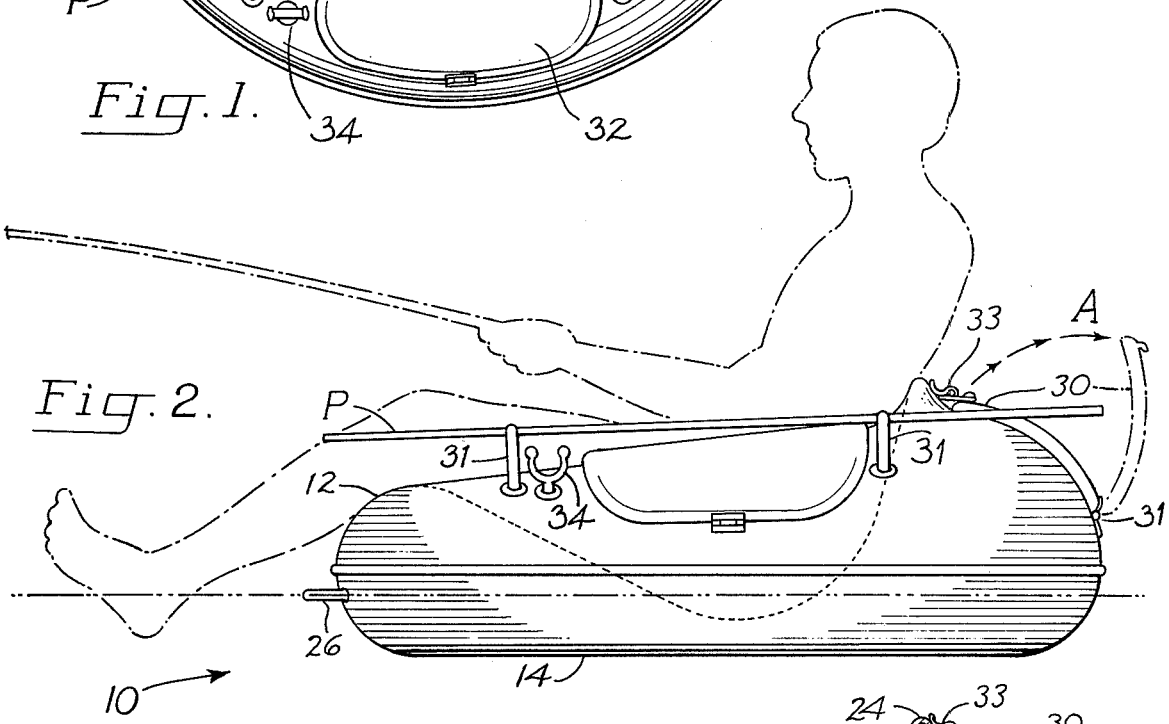
FIG. 2 is a side elevation view of the water vehicle illustrating a vehicle user in seated position for fishing.

Turning now to the drawings, and referring initially to FIGS. 1 and 2, the foot propelled water vehicle according to the present invention is generally designated at 10. The vehicle 10 includes a body having a generally annular periphery. The present invention contemplates that the vehicle 10 will be a hard-shelld body having curved sides 12 extending from a top portion of the vehicle 10 to a bottom 14. The bottom 14 is formed as a generally flat bottom surface and presents minimal hydrodynamic drag. A seating cavity or seat 16 is integrally formed with the body and defines a continuous surface having a generally U or V-shaped profile. This construction is shown in outline in FIG. 2 and in cross section in FIG. 3.

Figure 3:
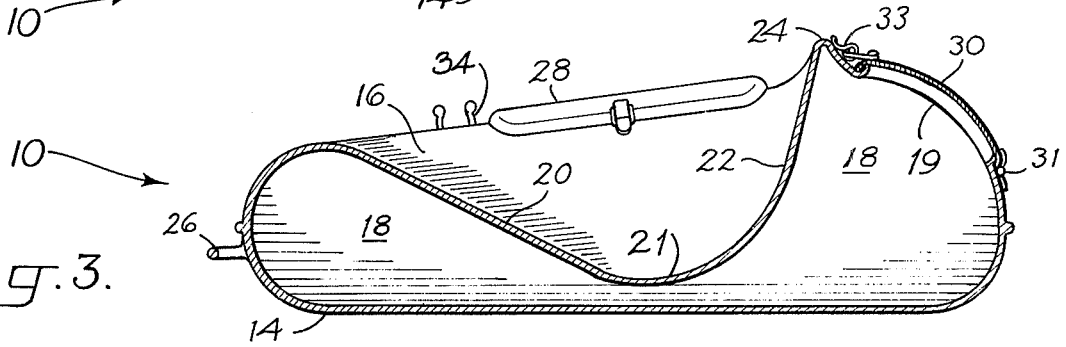
FIG. 3 is a cross-sectional side elevation view of the vehicle taken along lines 3—3 of FIG. 1.

As shown in FIG. 3, the vehicle 10 may be constructed of one piece, and includes a hollow interior 18. The seat 16 includes front and rear inclined portions 20, 22, respectively contoured so that the weight of an individual sitting or reclining in the vehicle 10 is concentrated primarily in a central portion 21. As such, stability is insured which is important for a small water vehicle of this type. The front portion 20 is sloped or inclined somewhat less with respect to the horizontal than the rear portion 22. Thus, an individual as shown in dotted outline in FIG. 2 may seat himself in the vehicle with his legs extending over a front of the vehicle so that he may propel himself and the vehicle by kicking his feet in the water.

Extending upwardly from the rear portion 22 is an extention or back rest 24. The back rest 24 is also integrally formed with the vehicle shell and provides additional reclining surface for an individual. Other features of the present invention include a towing ring 26 secured to the front of the vehicle 10 and a plurality of hatches 28, 30 and 32. The hatches 28, etc. may also be constructed of the same material as the vehicle 10 and connected by means of hinges and clasps to the vehicle 10 over an appropriate opening cut in the vehicle shell. For instance, as shown in FIGS. 2 and 3, an opening 19 is shown formed in the vehicle 10 such that the hatch 30 may be connected by means of a hinge 31 in order to be pivotally connected to the vehicle 10. Thus, the hatch 30 may be opened in the direction of arrows A (see FIG. 2) and retained in closed position by means of a clasp 33. The selectively openable and closeable hatches permit ready access into the interior 18 for stowage of fishing tackle and other gear. While only three hatches are shown in the drawings, it can be appreciated that the hatches may be situated on the vehicle as particular needs may dictate.

Another feature of the present invention resides in the use of upright supports 31 which are secured to side portions of the vehicle 10 so that fishing poles, hand paddles or other elongate objects may be secured to the vehicle 10. As shown in FIGS. 1 and 2, an elongate object such as a fishing pole P is situated on top of the supports 31 and may be secured thereto by means of elastic tie downs or rope, etc. While the vehicle 10 has been described as being constructed of a single shell, it must be appreciated that the vehicle could be constructed of two halves which are sandwiched together. In either method of construction, the hollow interior 18 could be readily provided. Furthermore, the interior 18 could be at least partially provided with flotation material such as balsa, foam, etc., to enhance buoyancy.

From the above description it should be readily apparent that the present invention provides a multitude of advantages for use as a recreational water vehicle. For instance, the fact that the vehicle 10 is of relatively small size and is constructed of a material to provide a hard shell, permits the vehicle 10 to be used in areas adjacent to shorelines for fishing, bird hunting, etc. The vehicle 10 is very mobile and the hard-shell construction prevents rocks or snags from puncturing the vehicle as would occur with known inflatable devices. Injury to a vehicle user would thereby be prevented. Additionally, the hard-shelled construction permits attachment of various accessaries or equipment such as the aforementioned towing ring 26 and the upright supports 31. In addition, oar locks 34 could be provided so that the vehicle 10 could be readily rowed or paddled from one area to another.

With respect to the hollow interior 18, it can be appreciated that the hatches 28, etc. provide a water-tight seal so that radios or other electronic gear could be stowed within the interior 18 in addition to stowage for fishing tackle, etc. The hatches 28, etc. provide ready access to the interior 18 and could additionally be provided with locks to prevent unauthorized access thereinto. Equipment such as depth finders, transducers, etc. could be attached to the vehicle 10 or stowed in the interior 18.

The U or V-shaped seat not only provides for comfortable and semi-reclining positioning of a vehicle user, but also situates the user's weight so that such weight is directed substantially along the vehicle's central, vertical axis. By distributing the weight as such, a high degree of stability is insured. Stability in such a small craft is important when it is realized that the vehicle 10 may be used in large bodies of water for fishing. In addition, the vehicle 10 of the present invention conceivably could be used as an emergency or rescue device such as a small lifeboat for individual use. Thus, the vehicle 10 may be used on the open sea and the interior 18 may be provided with various survival gear and emergency aids.

The vehicle 10 is contemplated as being constructed of fiberglass reinforced plastic, but could be constructed of any relatively hard material which would provide buoyancy. Furthermore, to provide additional buoyancy or to insure flotation even if the outer shell were punctured the interior 18 may be provided with foam material or a balsa core to insure flotation.

Additionally, it is to be noted that the bottom 14, being formed as a flat surface, presents minimal hydrodynamic drag. The bottom 14 and the annular periphery permit the vehicle 10 to be readily directed or positioned in the water by action of a user's feet.

While the invention has been shown and described with reference to the foregoing preferred embodiment, it will be understood by those skilled in the art that other changes in form and detail may be made therein without departing from the spirit and scope of the invention as defined in the appended claims. For instance, while the drawings show a vehicle 10 sized to accommodate only a single individual, a larger craft providing seating for more than one individual could be constructed using the principles of the present invention.

What is claimed is:

1. A foot propelled water vehicle comprising:

a hard-shelled body having a generally flat bottom, a generally circular periphery and curved sides, an upper surface curving from said sides inwardly to form a central V-shaped seating cavity, the space between said bottom and said upper surface defining the body interior, at least a portion of which is hollow, said seating cavity being integrally formed with said body and defining a continuous surface having downwardly inclined front and rear portions, said front portion being inclined at an angle less with respect to the horizontal than said rear portion, said cavity being sized and positioned to accommodate a seated individual therein with the individual's feet extending over the side of said body adjacent said front portion with the individual's weight substantially centered along the vehicle's central, vertical axis, and at least one opening provided on the periphery of said upper surface communicating with said hollow portion of said interior and being covered by an openable hatch cover permitting selective access to said interior.

2. The vehicle as defined in claim 1 wherein said interior portion is at least partially filled with flotation material.

3. The vehicle as defined in claim 1 wherein said rear portion includes an extension dimensioned above said curved sides, said extension providing additional reclining surface for an individual.

* * * * *